US010951966B1

(12) United States Patent
Thigpen

(10) Patent No.: US 10,951,966 B1
(45) Date of Patent: Mar. 16, 2021

(54) FLAT PLATE TRANSDUCER

(71) Applicant: F. Bruce Thigpen, Tallahassee, FL (US)

(72) Inventor: F. Bruce Thigpen, Tallahassee, FL (US)

( * ) Notice: Subject to any disclaimer, the term of this patent is extended or adjusted under 35 U.S.C. 154(b) by 20 days.

(21) Appl. No.: 16/548,962

(22) Filed: Aug. 23, 2019

(51) Int. Cl.
*H04R 1/02* (2006.01)
*H04R 9/04* (2006.01)
*H04R 9/06* (2006.01)

(52) U.S. Cl.
CPC ..... *H04R 1/025* (2013.01); *H04R 1/021* (2013.01); *H04R 9/045* (2013.01); *H04R 9/063* (2013.01); *H04R 2209/041* (2013.01)

(58) Field of Classification Search
None
See application file for complete search history.

(56) References Cited

U.S. PATENT DOCUMENTS 6,332,029 B1 * 12/2001 Azima ..... B42D 15/022 381/152
6,760,462 B1 * 7/2004 Thigpen ..... H04R 9/047 381/408
7,088,836 B1 * 8/2006 Bachmann ..... H04R 5/023 381/152
2006/0023902 A1 * 2/2006 Thigpen ..... H04R 7/04 381/176
2007/0110264 A1 * 5/2007 Bachmann ..... H04R 5/023 381/152
2018/0249248 A1 * 8/2018 Harris ..... H04R 29/002

* cited by examiner

*Primary Examiner* — Tuan D Nguyen
(74) *Attorney, Agent, or Firm* — J. Wiley Horton

(57) ABSTRACT

A flat plate audio transducer. A front panel and a back panel are connected via a frame. One or more electromagnetic actuators are mounted between the two panels. Voice coils are used as the actuators in some embodiments. Stiffening braces are preferably run between groups of actuators to prevent unwanted resonance phenomena. In some embodiments an actuator array moves both the front and back panels. In other embodiments only one panel is moved. The flat plate transducer is configured to mount on a room wall in a position that is conventionally used for decorative items such as artwork.

20 Claims, 14 Drawing Sheets

FLAT PLATE TRANSDUCER

CROSS-REFERENCES TO RELATED APPLICATIONS

Not Applicable.

STATEMENT REGARDING FEDERALLY SPONSORED RESEARCH OR DEVELOPMENT

Not Applicable.

MICROFICHE APPENDIX

Not Applicable.

BACKGROUND OF THE INVENTION

1. Field of the Invention.

This invention relates to the field of sound transducers. More specifically, the invention comprises a flat plate transducer that provides improved low-frequency sound and a more uniform sound distribution.

2. Description of the Related Art.

Sound transducers generally seek to efficiently and accurately transform an electrical input signal into sound waves. Electromagnetic voice coils have long been used for this purpose. A voice coil typically drives a cone suspended in a chassis. Various cabinets and waveguides are added to improve the result.

Another example is the placement of an electromagnetic driver in the throat of an elongated horn. Horn designs can be quite efficient in converting electrical energy to sound energy (5-50%). They provide effective impedance matching between the relatively dense speaker diaphragm material and the much less dense surrounding air. For this reason, they are often used in public address systems where high sound levels must be produced over a substantial distance.

A well-known approach to improving the low frequency response of a conventional electromagnetic transducer is to mount the transducer within a surrounding cabinet. FIG. 1 shows a representative example. Speaker assembly 20 includes transducer assembly 21 mounted to enclosure 32. The transducer assembly in this example is a flexible cone 26 driven by a coil assembly 24. Chassis 30 provides a physical mount for the cone and coil assembly. Chassis 30 includes a circular flange that is bolted to the perimeter of a circular opening in enclosure 32. Power is provided to the coil assembly via electrical terminals 28.

Entrapped volume 34 is a volume of air captured within the enclosure. This captured air acts as a spring to flatten the transducer assembly's overall frequency response and compensate for the attenuation in its low frequency output resulting from the mismatched acoustic impedance of the cone to the air. Bass port 36 may be provided for low frequency output.

Another approached was developed by Edward M. Long in the later 1970's. Long's approach was to electrically boost the input signal in the lower portion of the frequency band in order to drive the speaker with a greater amplitude for frequencies below the speaker's resonant frequency. The boosting was accomplished by electrical circuitry contained within an external amplifier or in some instances within the speaker assembly itself. Long's approach is explained in detail in U.S. Pat. No. 4,481,662.

Jose Bertagni addressed the frequency response problem by developing a flat panel transducer using a large and flexible panel set into an open frame which acts as a dipole. The Bertagni design is described in detail in U.S. Pat. No. 4,997,058. FIG. 2 depicts a physical embodiment of the Bertagni design. The figure shows a pair of Bertagni speakers. The speaker on the left is shown from the rear while the speaker on the right is shown from the front. Frame 40 mounts the transducer hardware. Base 42 provides a stable support platform.

Sound waves are produced by vibrating flat extruded polystyrene foam panels. Low frequency panel 52 is intended to produce low frequency sound while high frequency panel 54 is intended to produce high frequency sound. A separate "tweeter" (not shown) was sometimes included as part of each speaker. Low frequency coil 44 is connected to the frame via mounting bracket 50. High frequency coil 46 is likewise connected to the frame by mounting bracket 48.

Channel 54 extends through part of the thickness of low frequency panel 52. The channel is given a particular shape to tune the resonant characteristics of the flat plastic panel. Tuning weights and secondary channels are added in some versions. The net result of the Bertagni approach is a flatter frequency response.

During the 1990's a company called NXT developed a distribution mode sound radiating panel. This approach is described in U.S. Pat. No. 6,031,926 to Azima et. al. A simplified depiction of an embodiment of this invention is found in FIG. 3 (distribution mode panel 66). A flat panel 58 is connected to a relatively rigid frame 40 via an elastic connecting surround 56. Transducer 60 (typically a piezoelectric transducer) is attached to panel 58. The transducer is fed by amplifier 64. Second transducer 62 may be included as well. Panel 58 is typically a lamination of three layers. In one example the core layer is plastic foam. The outer layers on the front and back are metal foil.

With most all prior art designs, radiation resistance (impedance), efficiency, and the interaction between a speaker and the room surrounding it (room resonance modes) are neglected. Instead, the prior art designs attempt to optimize a flat frequency response in the area near the speaker (the "near field"). The enclosure and loudspeaker are an acoustic point source. At frequencies greater than the dimensions of the loudspeaker cone, the radiated energy becomes spherical and the listener's experience is then highly dependent on the listener's position within the room.

Prevailing design parameters for low frequency speakers were set out in a 1970 Audio Engineering Society paper by Thiele and Small. These parameters are known as "Thiele-Small parameters" within the art. High fidelity low frequency loudspeakers have been designed using these parameters since that time. However, using the Thiele-Small parameters results in a loudspeaker with very low efficiency (usually a few percent or less). Using these parameters also ignore the interaction between a loudspeaker and the room surrounding it.

A loudspeaker transducer creates extremely small changes in air pressure (sound pressure). The electrical current used to drive such a transducer faces an internal source impedance and drives an external load impedance (the surrounding air). The impedance of the air is low because of its low density. The internal source impedance is high. Hence, there is a considerable mismatch between the source impedance and the load impedance. The result is that most of the electrical energy put into a direct radiating loudspeaker will be converted to heat and will not be converted to sound energy. The problem is worse at low frequencies, where the physical size of the source (the cone diameter) will be small compared to the wavelength of the sound wave produced. The result is that air slips around the speaker diaphragm instead of changing pressure. Efficiencies of just a few percent are the accepted norm.

At higher frequencies the wavelength of the sound wave produced is of course smaller compared to the loudspeaker cone dimensions. The sound in this frequency range becomes directional and the driver becomes more efficient. If a driver can be made to radiate directional waves across its entire frequency operating range, efficiency is increased.

Thiele-Small design parameters suggest the use of a large enclosure and a relatively small moving diaphragm (cone) to make up for the loss in low-frequency efficiency from a small transducer. These systems increase amplitude using the resonance of the air volume trapped behind the cone combined with the mass and stiffness of the cone suspension. These parameters set a low frequency cutoff, below which the velocity of the cone drops significantly.

Thiele-Small parameters dictate a cabinet enclosure area to cone surface area ratio of about 10 to 1 or higher. A rigid enclosure is needed to prevent cabinet resonance modes. The use of these parameters trade efficiency for bandwidth and define an acoustic point source at low frequencies. Efficiency is given up in exchange for extended low frequency response. The user of the parameters dominates the commercial market.

The solution proposed in the present invention incorporates a very large diaphragm relative to the enclosure surface area and very small-displacement actuators as compared to traditionally-designed loudspeakers. Efficiency is increased via improved impedance matching, room acoustic frequency response is improved by radiating low frequencies from a very large area diaphragm.

BRIEF SUMMARY OF THE INVENTION

The present invention comprises a flat plate audio transducer. A front panel and a back panel are connected via a frame. One or more electromagnetic actuators are mounted between the two panels. Voice coils are used as the actuators in some embodiments. Stiffening braces are preferably run between groups of actuators to prevent unwanted resonance phenomena. In some embodiments an actuator array moves both the front and back panels. In other embodiments only one panel is moved. The flat plate transducer is configured to mount on a room wall in a position that is conventionally used for decorative items such as artwork.

REFERENCE NUMERALS IN THE DRAWINGS

Figure 1:
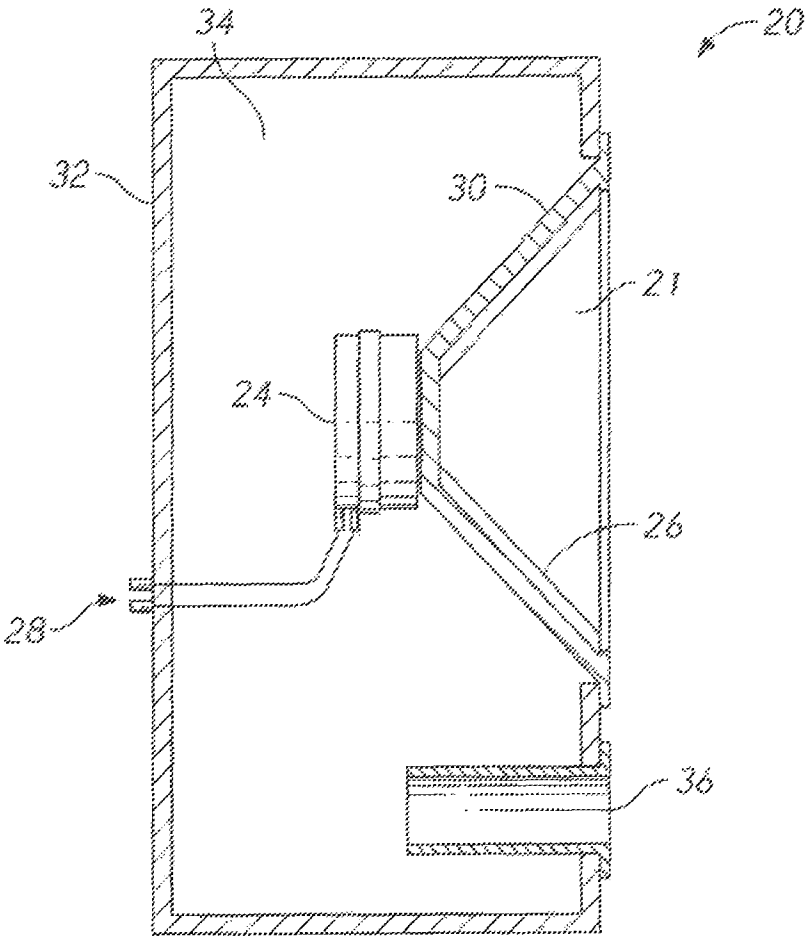
FIG. 1 (Prior Art)
FIG. 1 is a sectional elevation view, showing a prior art bass reflex enclosure.
Figure 2:
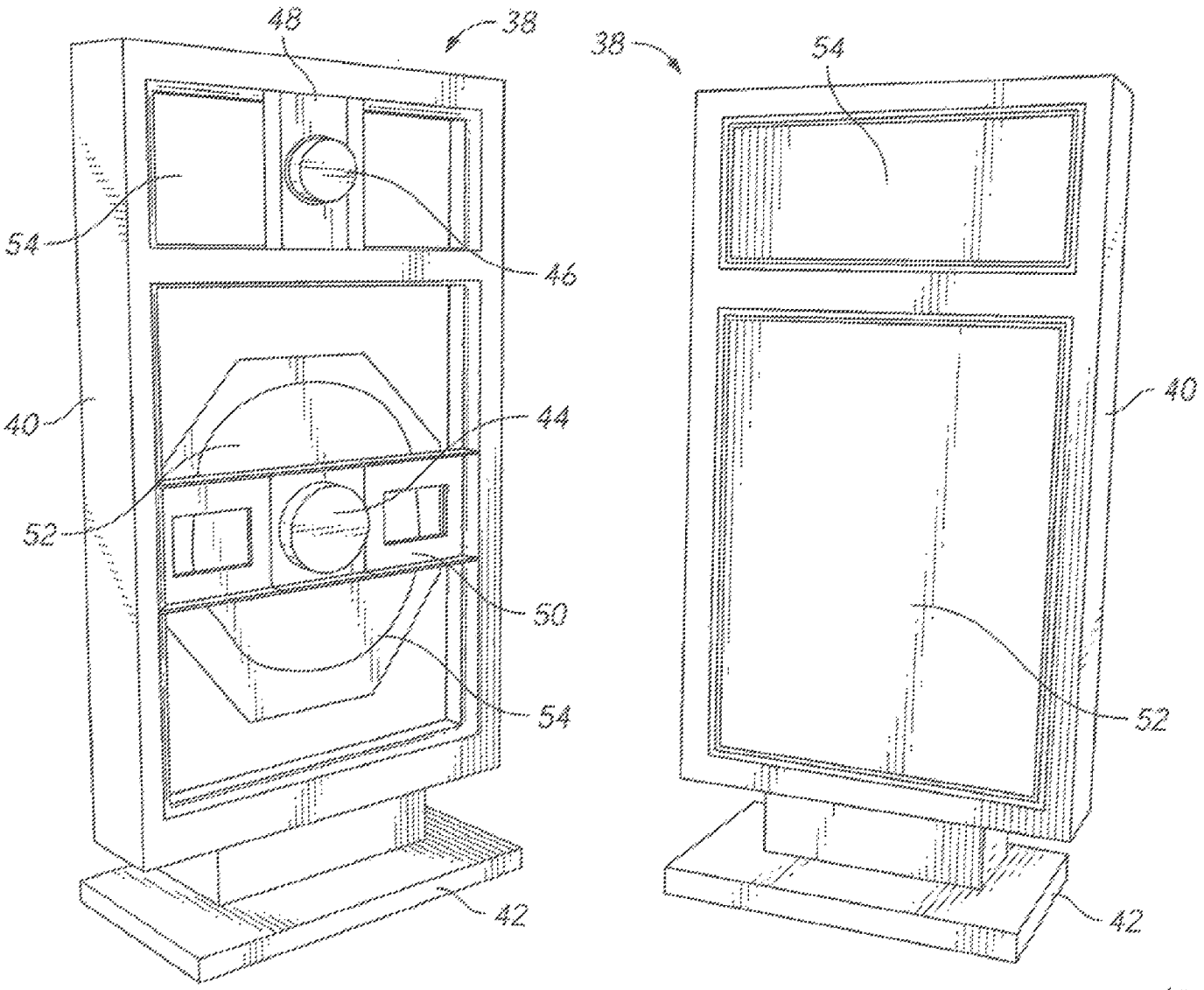
FIG. 2 (Prior Art)
FIG. 2 is a perspective view, showing a prior art flat panel transducer.
Figure 3:
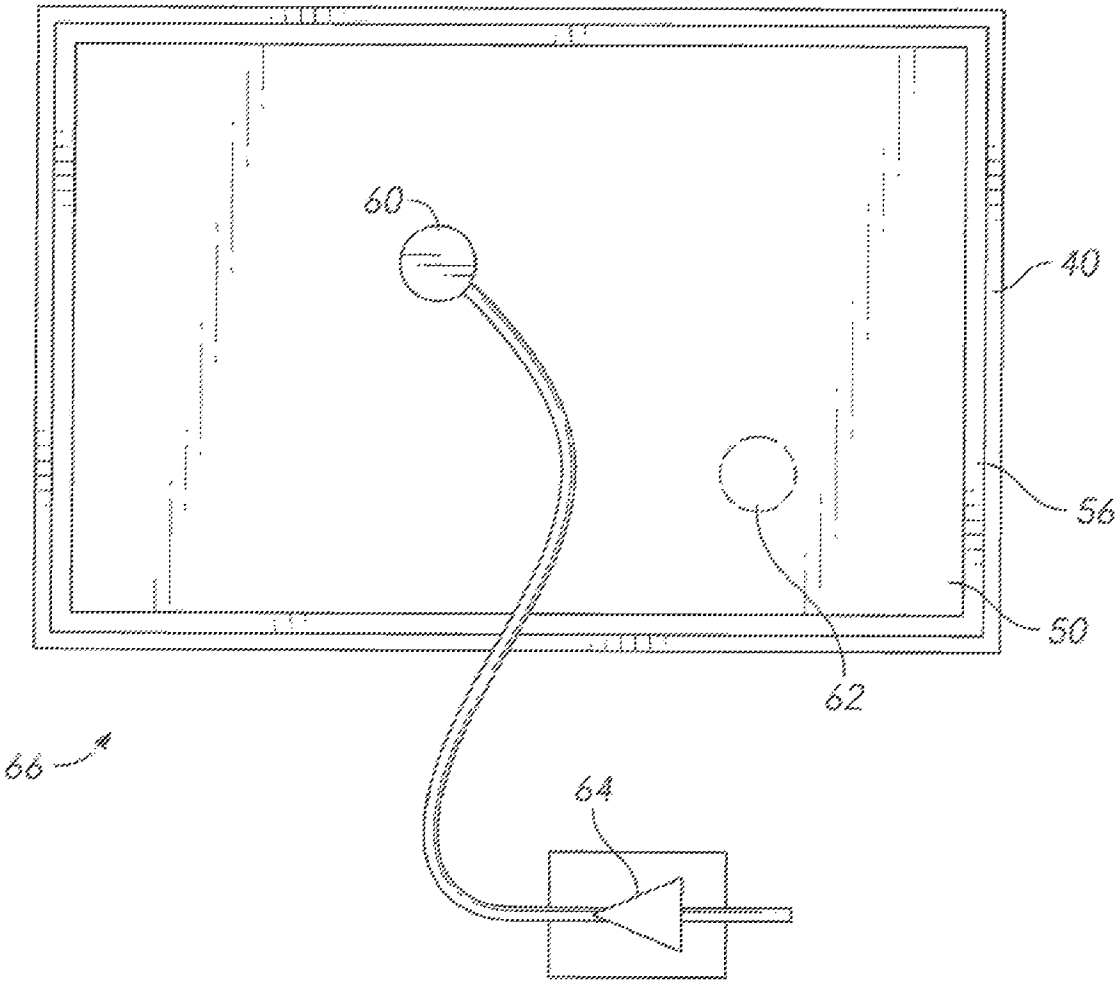
FIG. 3 (Prior Art)
FIG. 3 is an elevation view, showing a prior art flat panel transducer.

20 speaker assembly
21 transducer assembly
24 coil assembly
26 cone
28 electrical terminals
30 chassis
32 enclosure
34 entrapped volume
36 bass port
40 frame
42 base
44 low frequency coil
46 high frequency coil
48 mounting bracket
50 mounting bracket
52 low frequency panel
54 channel
56 connecting surround
58 panel
60 transducer
62 second transducer
64 amplifier
66 distribution mode panel
68 flat panel loudspeaker
70 frame
72 back panel
74 hanger
76 standoff
78 electrical connections
80 stiffening brace
82 front panel
84 actuator
86 front longitudinal stiffening brace
88 back longitudinal stiffening brace
90 adhesive bond
92 adhesive bond
94 wiring
95 connector
96 magnet assembly
98 voice coil assembly
100 extension piece
102 electrical connectors
104 surround
106 front lateral stiffening brace
108 actuator location
110 flat panel loud speaker
112 room
114 wall

116 wall
118 wall

DETAILED DESCRIPTION OF THE INVENTION

Figure 4:
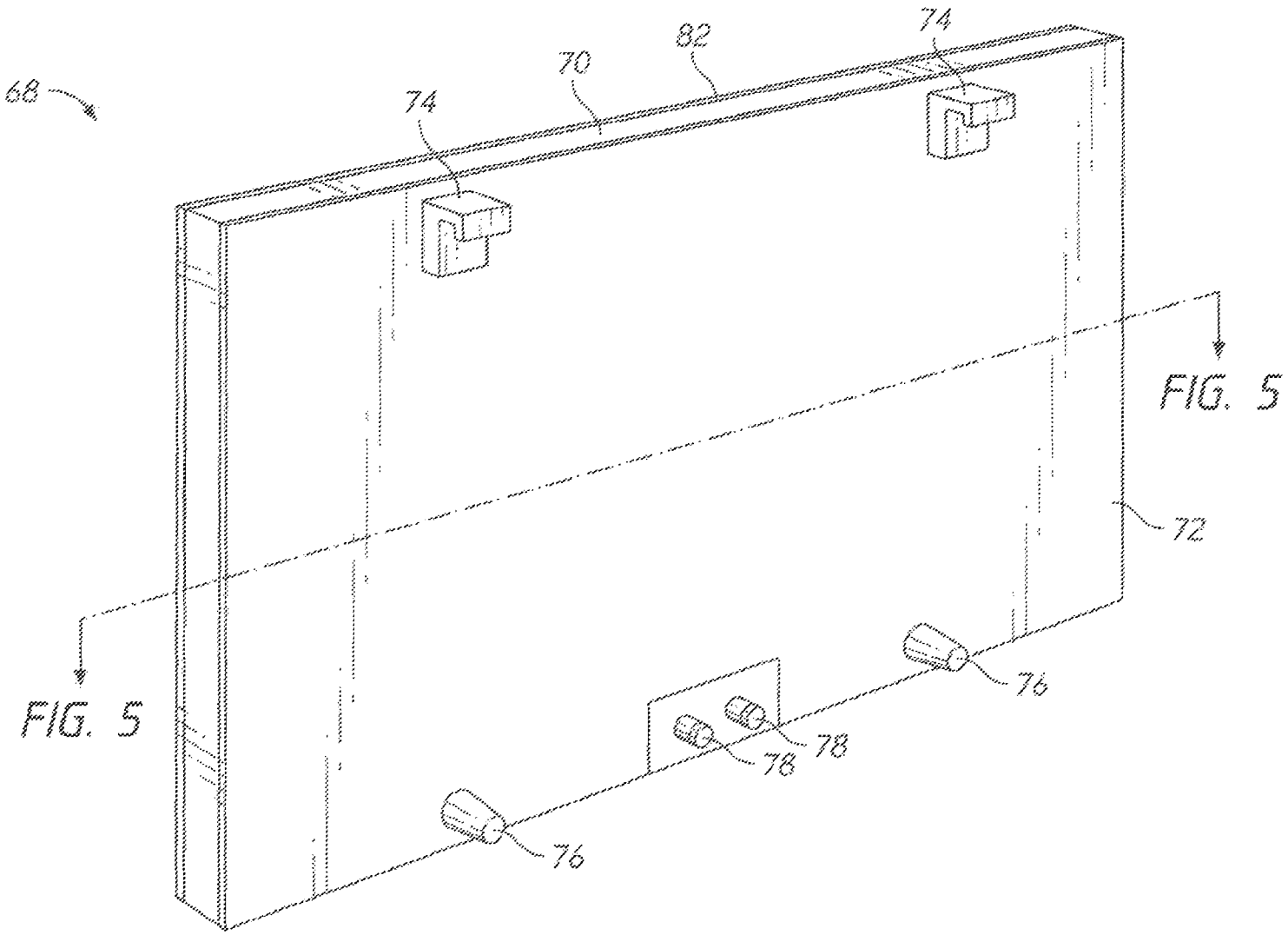
FIG. 4 is a perspective view, showing a flat panel transducer made according to the present invention.

FIG. 4 shows one embodiment of the present invention. Flat panel loudspeaker 68 is configured to transform electrical signals into sound waves in an efficient manner. Electrical connections 78 are provided for the input signal. Two speaker wires are attached to these connections. The connections themselves may assume a wide variety of forms.

The example of FIG. 4 is intended to hang on a wall in the same manner as a piece of artwork. Two exemplary hangers 74 are provided for this purpose. Two standoffs 76 are provided near the devices's lower edge to maintain a desired spacing from the wall in this example. The standoff height is preferably that required to place the back panel parallel to the wall. The standoff height can be made adjustable so that the user can "tune" the angle between the back panel and the wall.

Back panel 72 is joined to front panel 82 by frame 70. The front and back panels each have a perimeter. In this example the frame runs around the perimeter of the assembly and does not extend very far into the interior (an open interior area is left). The panels themselves are preferably made of a thin and stiff material. Exemplary materials include FR-4 (glass-reinforced epoxy laminate), cotton paper saturated with phenolic resin, carbon fiber reinforced resin, and COROPLAST (corrugated plastic sheet).

Figure 5:
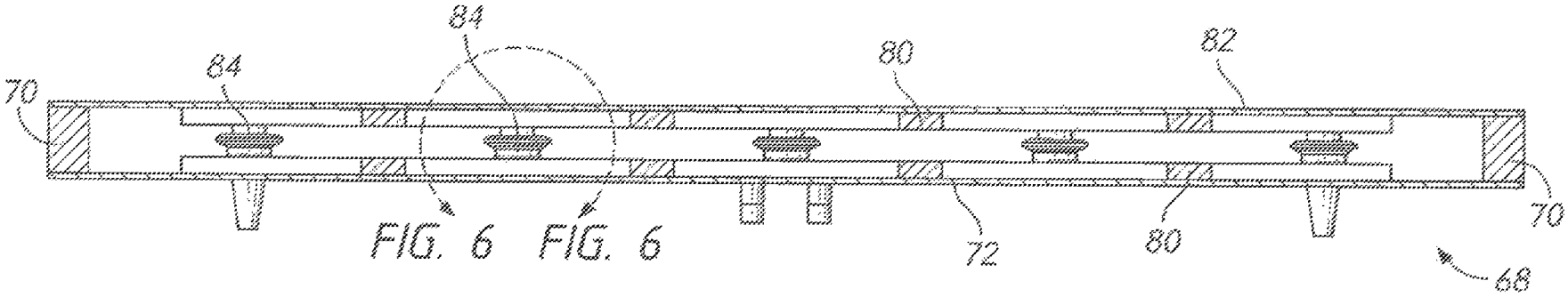
FIG. 5 is a sectional view, showing internal details of the embodiment of FIG. 4.

FIG. 5 shows a section view through the embodiment of FIG. 4 (through the plane indicated in FIG. 4). Frame 70 connects the outer perimeter of the two panels 72, 82. The panels can be attached to the frame by any suitable method. In the embodiment shown, high-strength adhesive is used (a two-part epoxy). Between the two panels a plurality of actuators 84 are mounted. These actuators push the panels apart and pull the panels together in response to electrical signals. While it is possible to attach the actuators directly to the panels themselves, it is preferable to place a series of stiffening braces 80 between the actuators and the panels. These stiffening braces spread the force applied by the actuators over a larger area.

Figure 6:
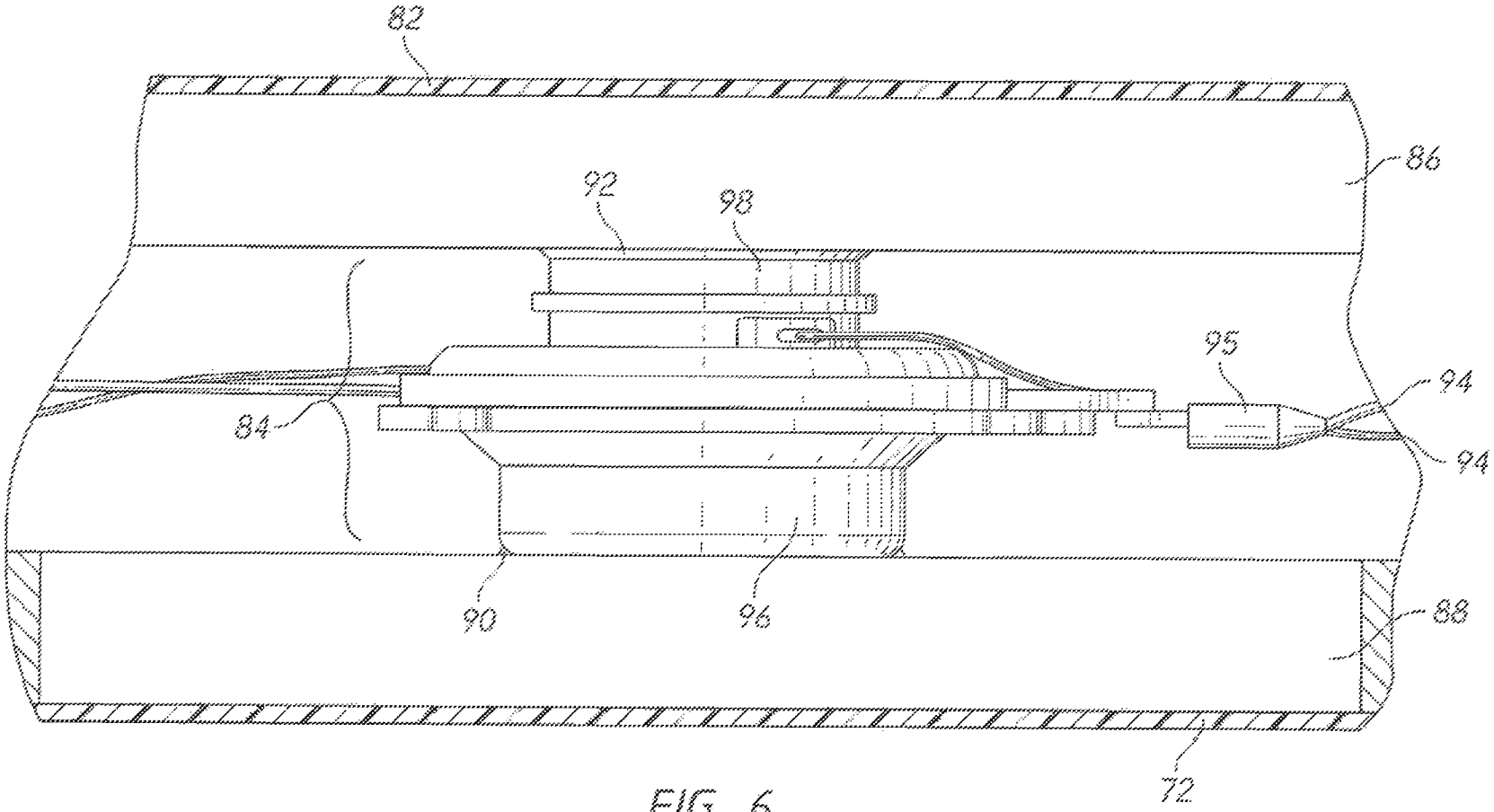
FIG. 6 is a detailed sectional view, showing one of the actuators used in the embodiment of FIG. 4.

FIG. 6 shows an enlarged portion of FIG. 5—in the vicinity of a single actuator 84. In this example the actuator is a small, commercially available speaker. Magnet assembly 96 is contained within a rigid metal chassis. Voice coil assembly 98 moves in response to electrical signals applied through wiring 94 and connectors 95.

In the region shown, two stiffening braces are present. Back longitudinal stiffening brace 88 is adhesively bonded to back panel 72. Likewise, front longitudinal stiffening brace 86 is adhesively bonded to front panel 82. The chassis of the actuator is bonded to brace 88 via adhesive bond 90. Voice coil assembly 98 is bonded to brace 86 by adhesive bond 92. (The voice coil includes an extension piece attached to the center of the moving cone as will be described in more detail subsequently).

The actuators in this example essentially "float" between the two moving panels. The actuators are—on average—much more dense that either stiffening braces 86, 88 or panels 72, 82. Whether actuated to push the panels apart or pull them together, the actuators tend to remain in a relatively stable position while the panels move outward or inward.

Figure 7:
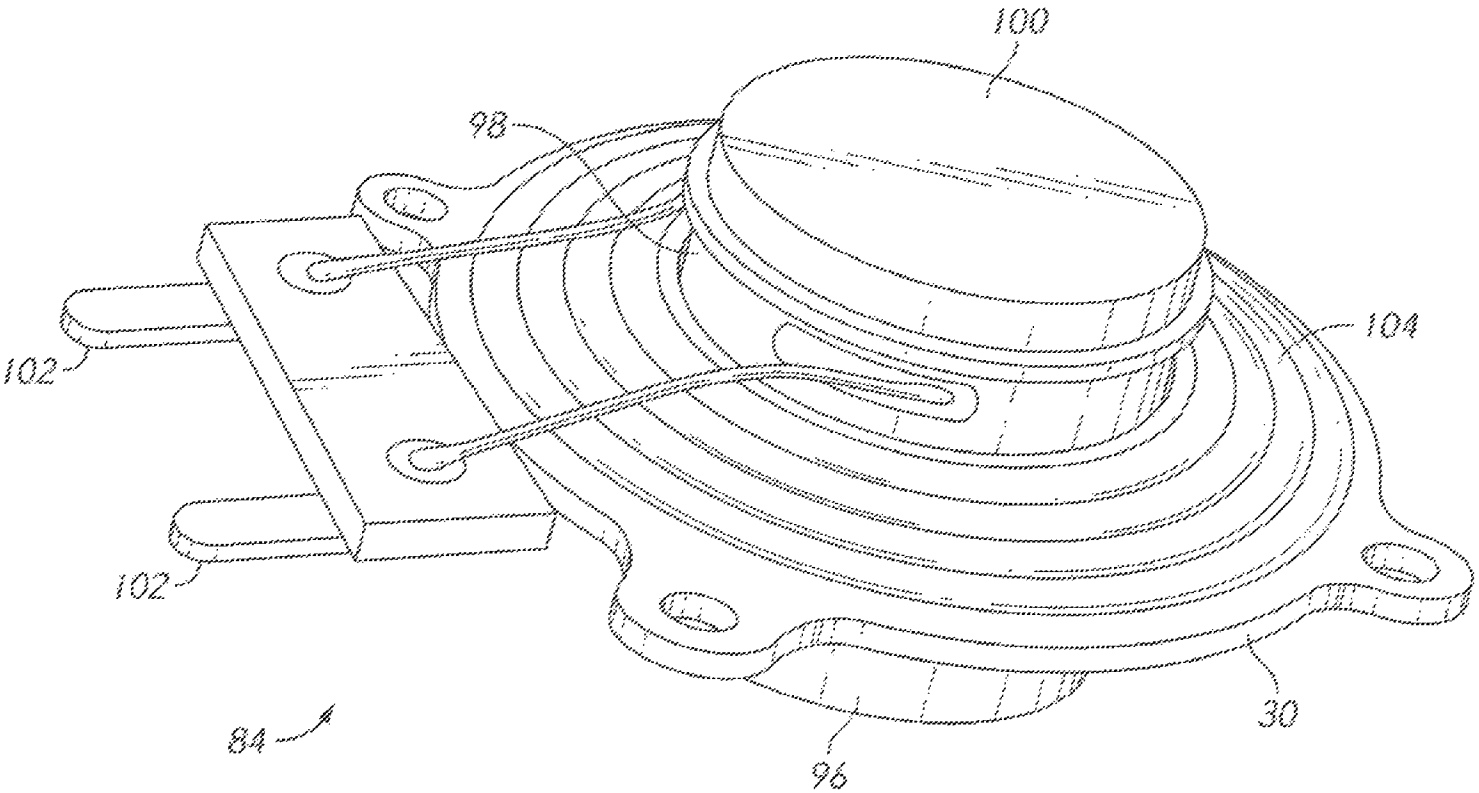
FIG. 7 is a perspective view, showing one of the actuators used in the embodiment of FIG. 4.

FIG. 7 provides a perspective view of an exemplary actuator 84. Chassis 30 is a metal stamping that houses magnet assembly 96. Voice coil assembly 98 includes a conventional copper winding that is attached to electrical connectors 102. Flexible surround 104 connects the voice coil to chassis 30 (usually referred to as a "cone" in a larger speaker). Extension piece 100 is bonded to the voice coil and moves in unison with the voice coil. The extension piece in this example is made of lightweight plastic so that it does not add significant inertia. The forward most portion of extension piece 100 is a planar surface that is parallel to the planar surface on the base of the chassis. Returning briefly to FIG. 6, it is the outermost portion of extension piece 100 that is bonded to stiffening brace 86 via adhesive bond 92—as shown. The result is that the actuator has a first side and a second side. One of the two sides is bonded to the front panel and one of the two sides is bonded to the back panel. The actuator responds to an electrical current in one direction by urging the first side away from the second side and an electrical current in the opposite direction by urging the first side toward the second side.

Figure 8:
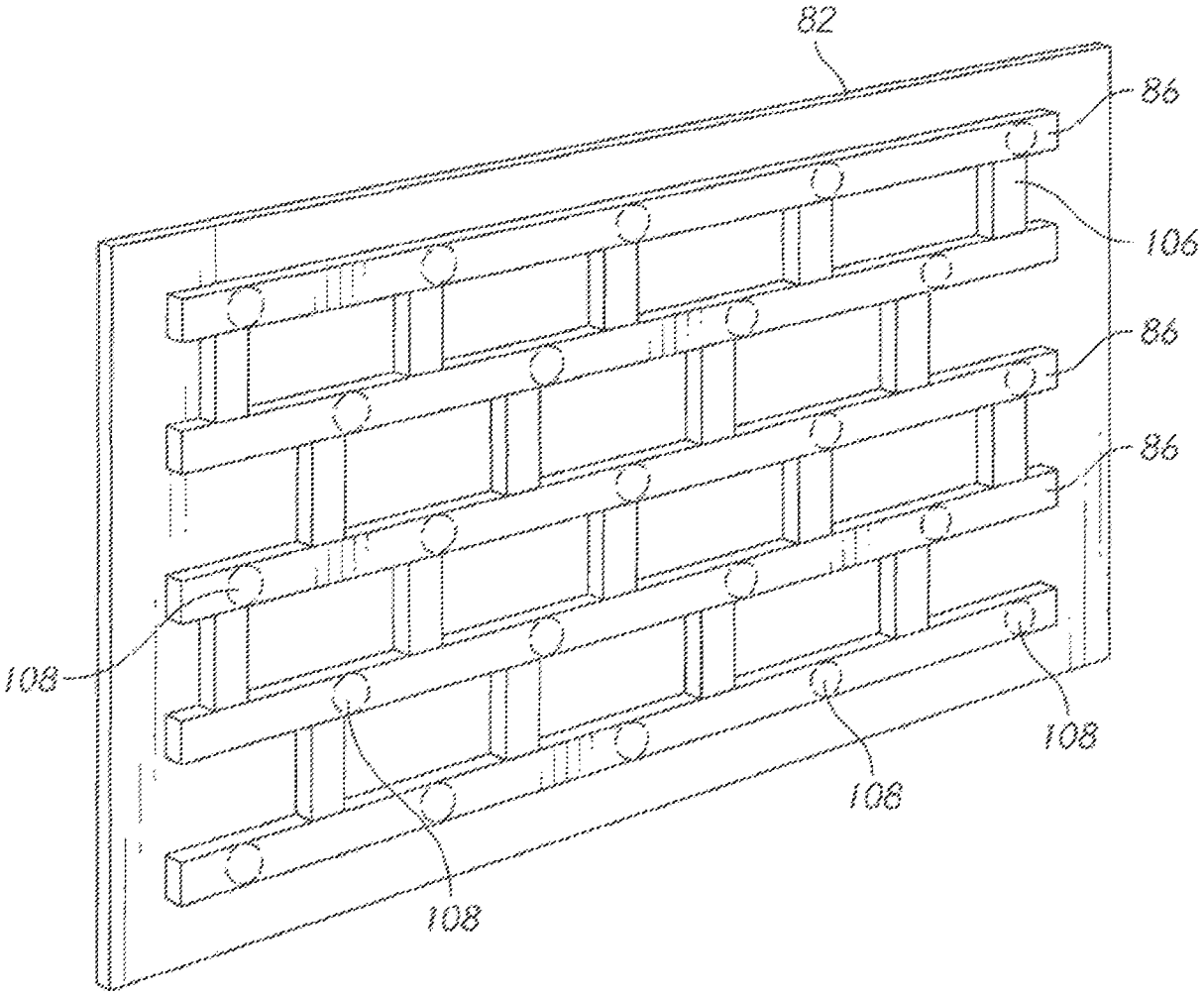
FIG. 8 is a perspective view, showing a front panel and stiffening bracing used in the embodiment of FIG. 4.

As discussed previously, a series of stiffening races are preferably added to the inner and outer panels to spread the forces applied by the transducers over a larger area. The invention is not limited to any particular construction methodology. However, in the example shown, the stiffening braces are bonded to the inward-facing side of panels 72, 82 before the panels are joined to the frame. FIG. 8 shows a perspective view of front panel 82 with the inward-facing side of the panel facing the viewer.

In the embodiment shown, five front longitudinal stiffening braces 86 are bonded to front panel 82. Eighteen front lateral stiffening braces 106 are bonded in place in an orientation that is perpendicular to the longitudinal stiffening braces. Actuator locations 108 are shown as dashed lines.

Figure 14:
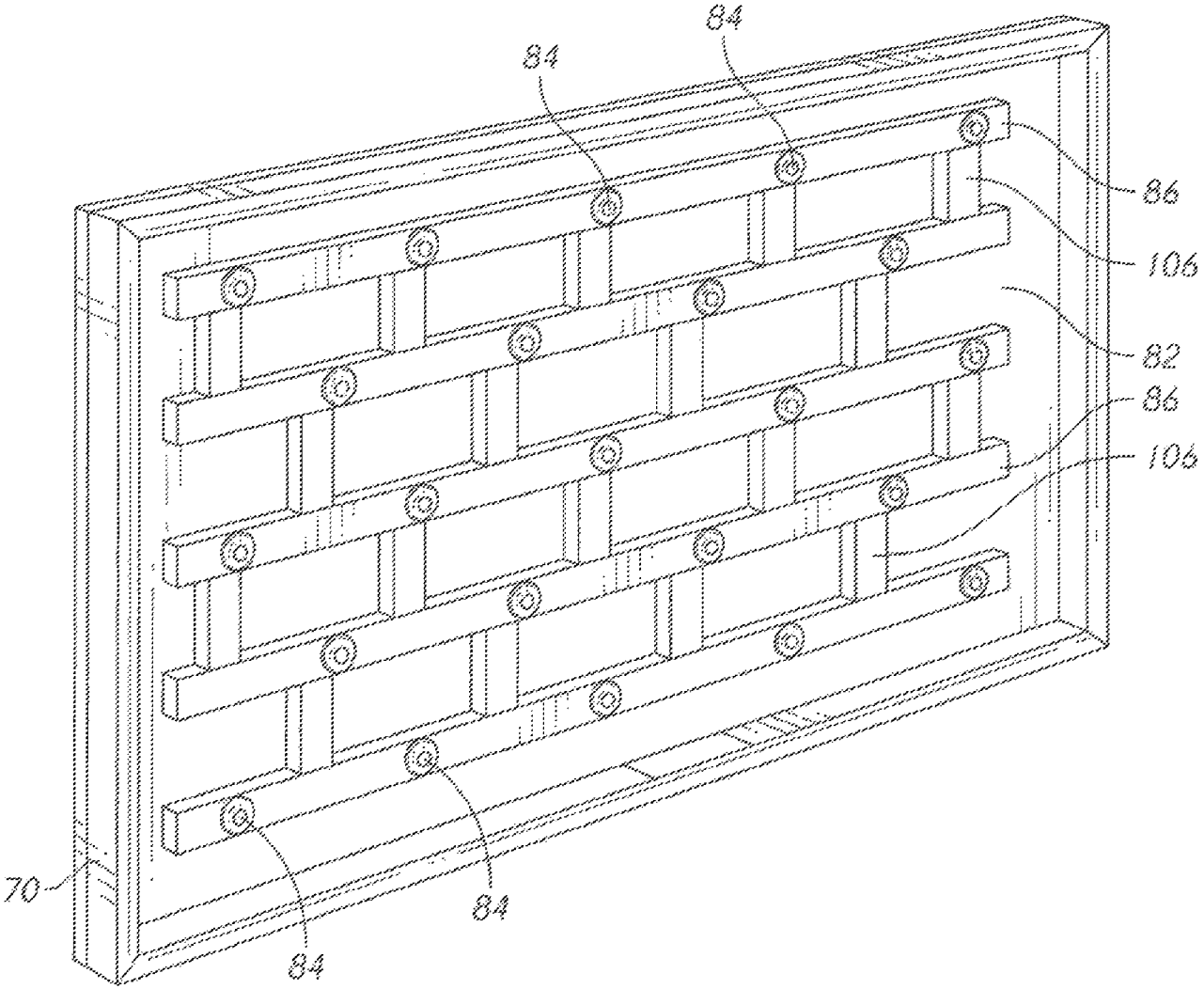
FIG. 14 is a perspective view, showing internal details of the embodiment of FIG. 4.

FIG. 14 shows the same front panel 82 after the addition of frame 70 around the perimeter. In this example frame 70 is made of four separate pieces with 45-degree miter joints at the corners. The frame pieces are bonded to front panel 82 using a strong adhesive. Actuators 84 are bonded to the stiffening braces—also using adhesives. The reader will note that adjacent actuators have opposite orientations. For example, the actuator 84 on the lower left has its chassis (proximate the magnet assembly) bonded to the stiffening brace. The actuator immediately to its right has its extension piece 100 bonded to the stiffening brace. Thus, in a first actuator the magnet side will be bonded to the front panel and in the next adjacent actuator the voice coil side will be bonded to the front panel.

Back panel 72 is prepared as an assembly with its stiffening braces bonded in place (analogous to the state shown for the front panel in FIG. 8). The back panel assembly is then bonded to the assembly shown in FIG. 14 using adhesive applied to the mating surfaces of the actuators 84 and frame 70. In all these views the electrical wiring and connectors have been omitted for purposes of visual clarity.

Figure 9:
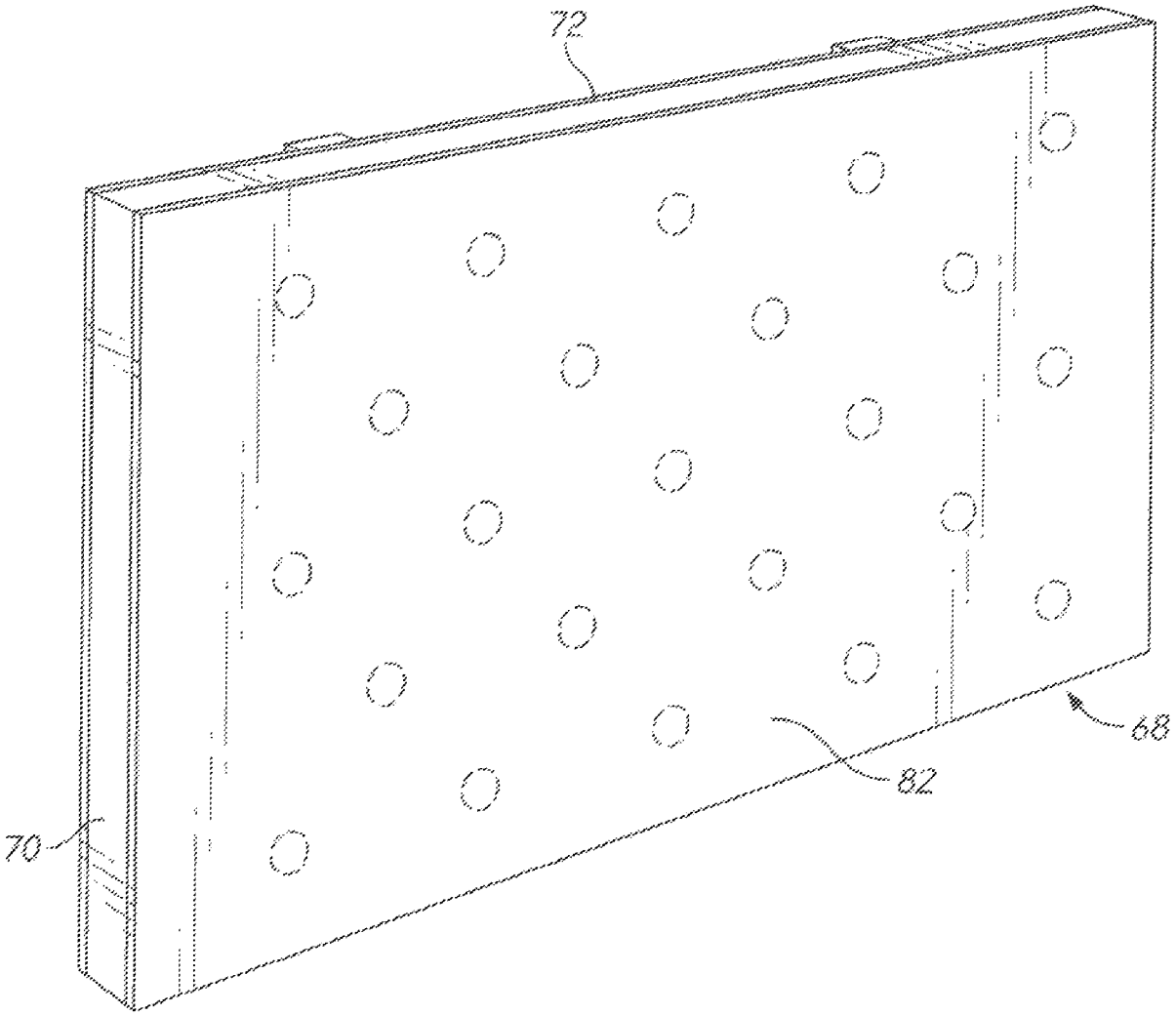
FIG. 9 is a perspective view, showing the approximate location of the actuators in an exemplary transducer array.

FIG. 9 shows the completed assembly with front panel 82 facing the viewer. The location of the actuators in the actuator array are shown in dashed lines. Mass production techniques can be applied to improve efficiency in the manufacturing process. As an example, adhesive can be applied to all the bonded surfaces using a mask or a computer-controlled dispensing machine. A jig can be used to hold all the components in the proper position while they are being joined. It is possible to create all the joints required by stacking all the components together in a single operation.

Figure 10:
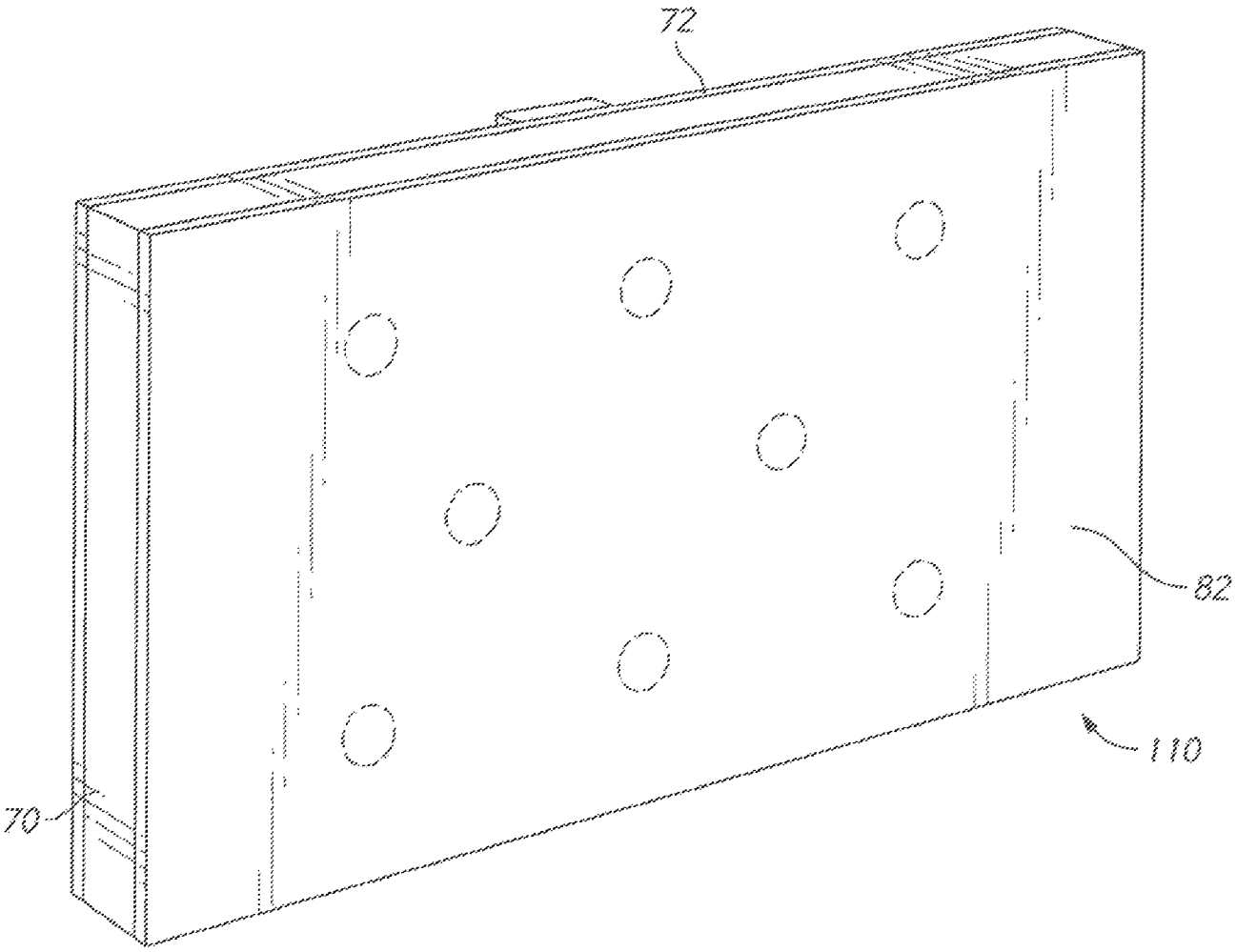
FIG. 10 is a perspective view, showing the approximate location of the actuators in a second exemplary actuator array.

The invention is not limited to any particular overall side or number of actuators. FIG. 10 shows a smaller rectangular embodiment in which a smaller number of actuators is employed. As for the prior example, front panel 82 and back panel 72 are joined via frame 70. Rectangular shapes have been illustrated, but he invention is not limited to these. A square outline could be used, as well as a triangular outline, a circular outline, or other desired shapes. A smaller number of actuators can be used as well, including just a single actuator.

The invention can be mounted in a variety of ways. It is possible, for example, to mount the invention in a floor stand. The preferred method, however, is to hang the invention on a wall in a manner similar to hanging a piece of artwork. In fact, artwork can be printed on front panel 82 so that the inventive loud speaker appears to be decorative rather than functional.

Figure 11:
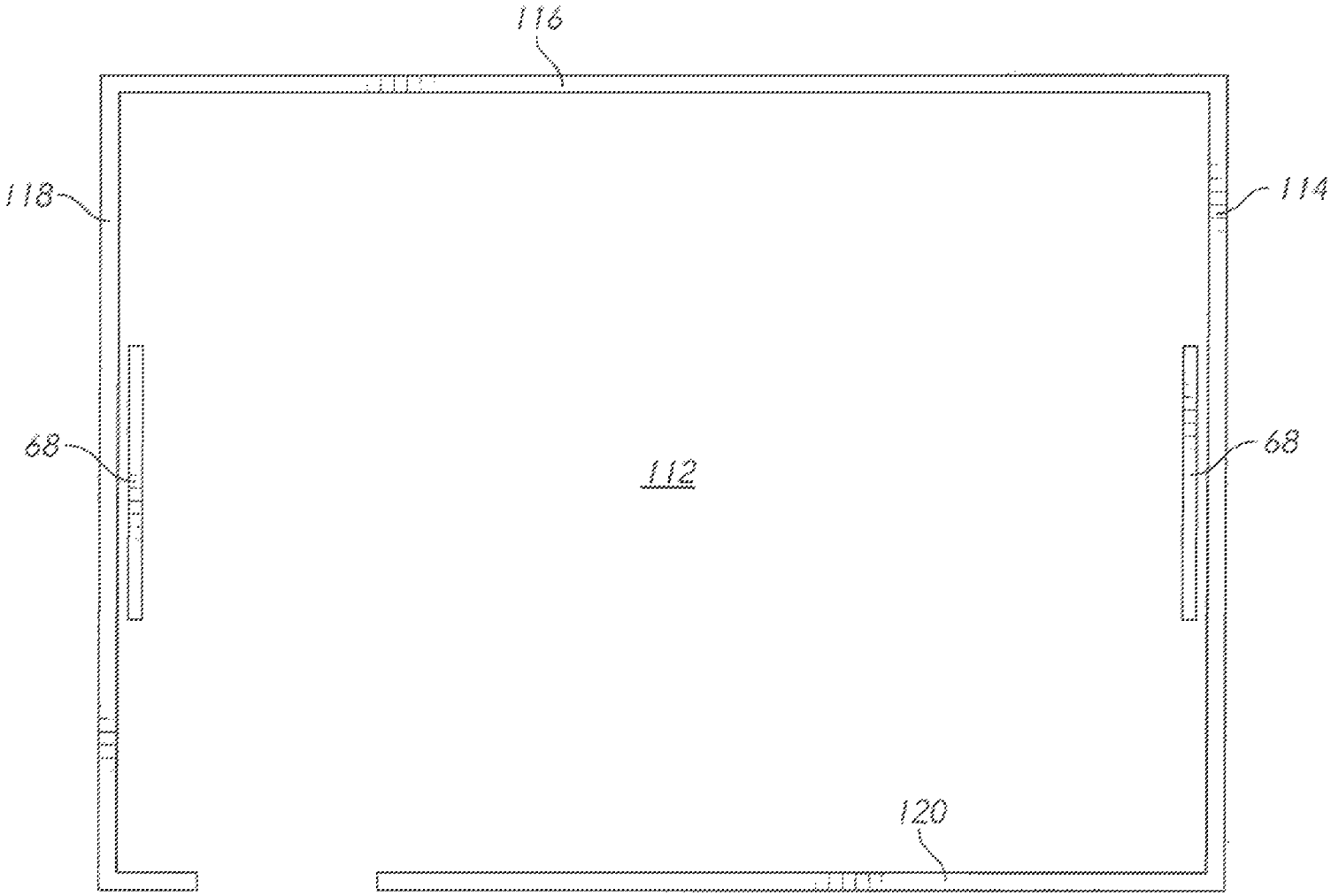
FIG. 11 is a plan view, showing the placement of the inventive transducers in a room.
Figure 12:
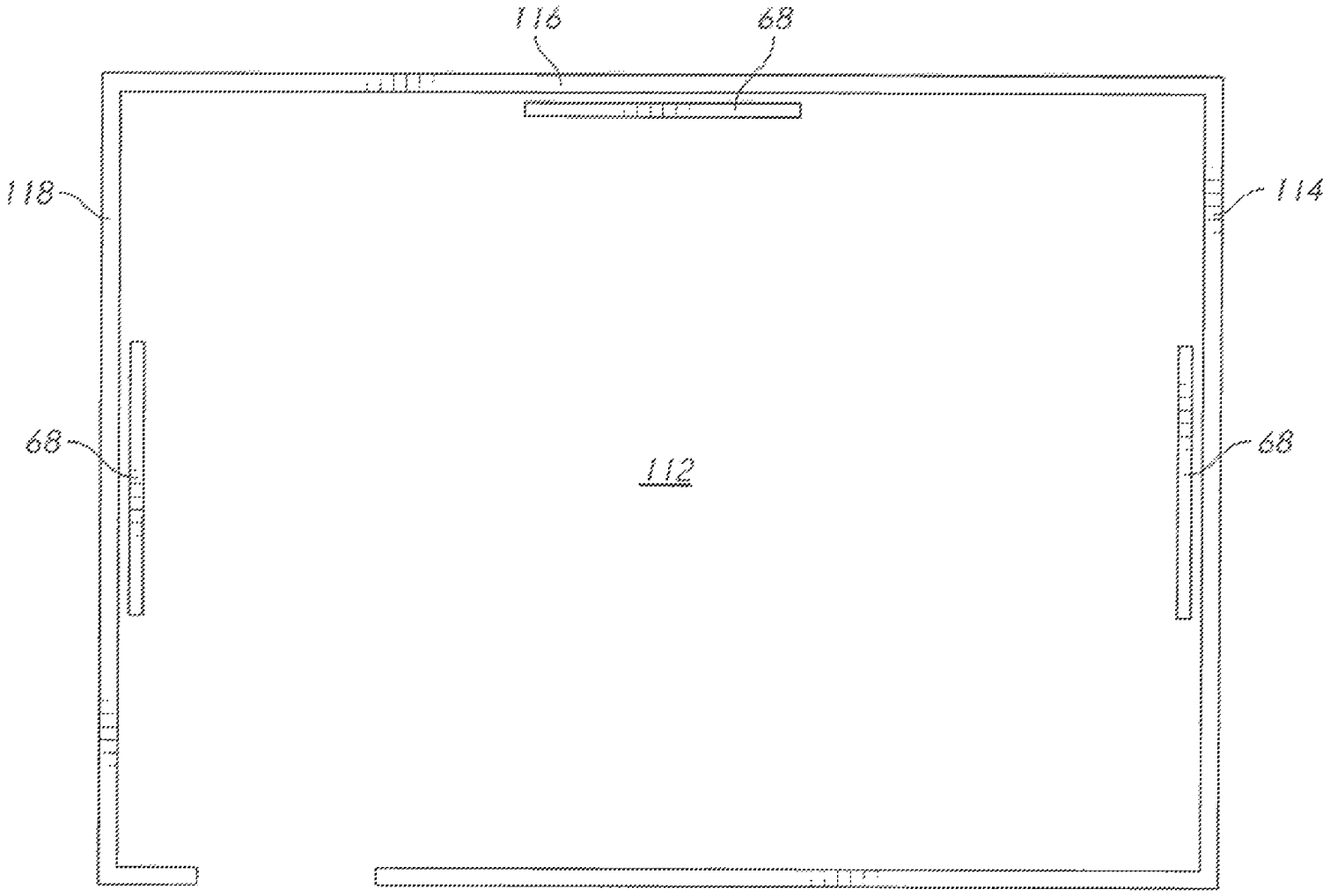
FIG. 12 is a plan view, showing the placement of the inventive transducers in a room.

FIG. 11 shows a plan view of an exemplary room 112, bounded by walls 114, 116, 118, and 120. A flat panel loud speaker 68 is hung on wall 114. A second inventive loud speaker 68 is hung on wall 118. FIG. 12 shows the same room 112 with a third inventive loud speaker being hung on wall 116.

Figure 13:
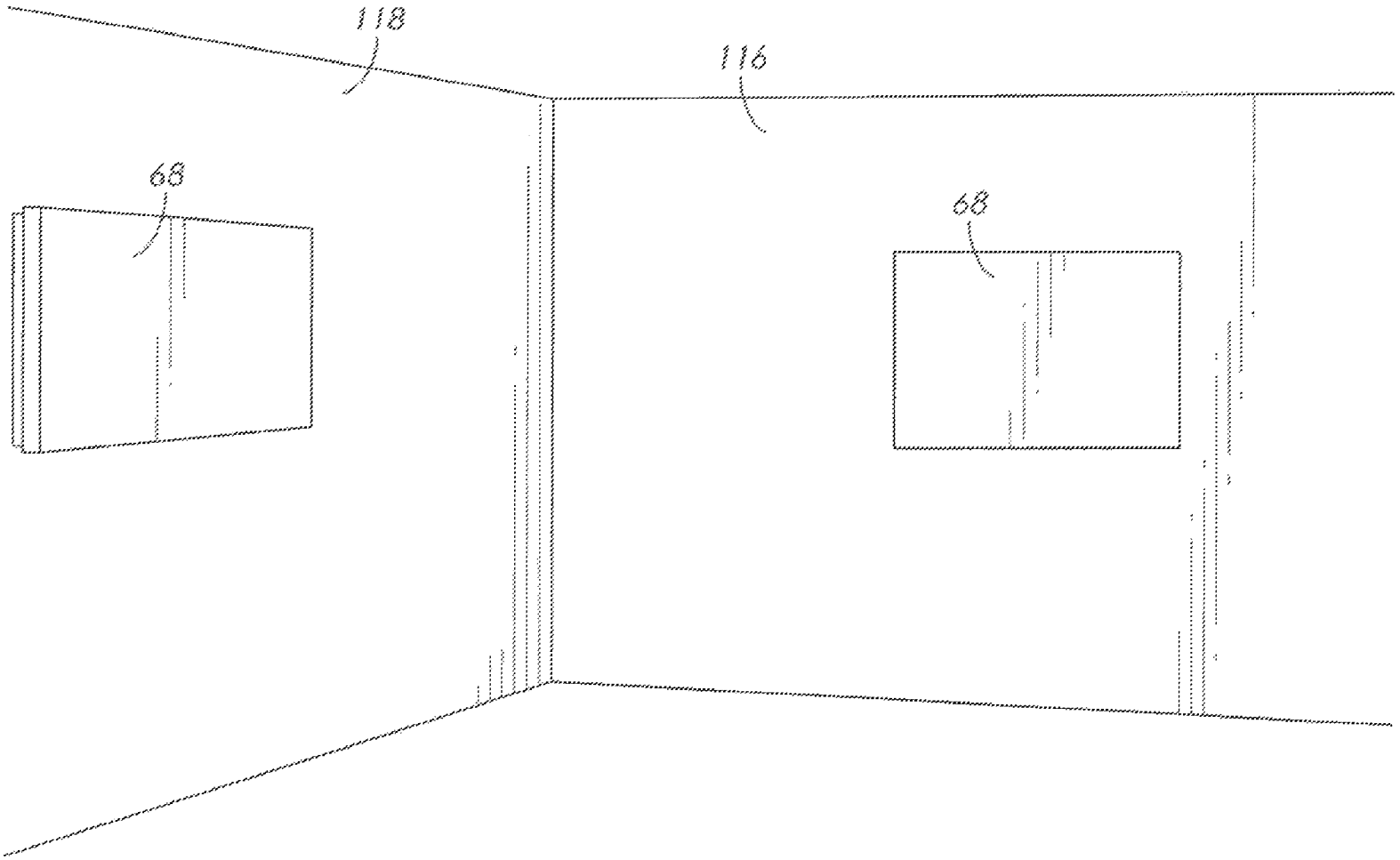
FIG. 13 is a perspective view, showing the placement of the inventive transducers in a room.

FIG. 13 shows a perspective view of the room in FIG. 12. The two flat panel loud speakers 68 are hung approximately at eye level. As stated before, the front panel may be covered with artwork so that the loud speakers are decorative as well as functional.

The materials used for the stiffening braces are preferably light and strong. In the embodiments using adhesive bonding the materials should also possess surfaces suitable for the adhesives being used. Wood works well for both the stiffening braces and the frame. It is also possible to use composite materials for these components. In looking at the assembly of FIG. 8, those skilled in the art will realize that it is also possible to mold the panel and the stiffening braces as one integral unit—such as by using composites.

In the preferred embodiments both the front panel and the back panel are moved by the transducers. It is also possible, however, to have one rigid panel and one moving panel. For the one-moving-panel embodiments the rigid panel must be stiffer so that it will not move. The versions using two moving panels have the advantage of twice the surface area acting to produce sound energy.

The actuators used in the invention can be wired in series or in parallel (or combinations of the two), depending on the most advantageous arrangement for the circuitry used to drive them. The wiring used inside the inventive panel can be conventional wiring, flex circuits, printed circuit boards, or other components. In fact, the wiring for the actuators could be printed on one or more of the panels themselves. Contract pads could also be included on the actuators so that electrical connections are made to the actuators at the same time the mechanical connection is made.

Having described in detail the mechanical construction of some of the embodiments of the invention, the invention's operational advantages will now be discussed. The inventive flat panel loud speaker incorporates a very large diaphragm relative to the enclosure's surface area and very small displacement actuators as compared to traditional loudspeakers. These features allow the inventive design to maximize the power delivered to the air—foregoing the traditionally accepted speaker design goals of the enclosure volume and resonance. When one plots electrical impedance versus frequency with traditional speaker designs, a sharp impedance peak is observed at a particular frequency. When the diaphragm area is substantially increased with respect to the cabinet area (as for the present design), this peak is substantially reduced and the transfer of electrical energy to acoustic energy is improved.

In the case of a loudspeaker, acoustic impedance matching maximizes power delivered to the air from the loudspeaker. Air ahs a very low impedance with respect to a traditional loudspeaker's moving diaphragm because the diaphragm has a relatively small surface area. The loss in efficiency is proportional to the wavelength of the sound produced relative to the size of the speaker's cone. Efficiency becomes quite poor at low frequencies because of the longer wavelengths involved.

To match the source to the load, the source impedance needs to be made as low as possible. The specific acoustic impedance of free air is approximately 42 ohms per square centimeter. Impedance can be matched by using a large area loudspeaker diaphragm. In the present invention, most of the loudspeaker is diaphragm (most of the back and front panel areas) and very little is cabinet (frame 70 along with the stiffened region immediately adjacent to it). Essentially the present invention trades "box volume" for a better impedance match and thereby achieves much better efficiency in transferring electrical energy to sound energy. The enclosure used is also simplified and its weight is greatly reduced.

Prior art woofers exhibit a smooth and flat frequency response in a near field measurement, but they also do not distribute the sound energy evenly in a room. Since they are essentially a low frequency point source, sound measurements taken throughout a room will show numerous peaks and valleys from reflections and standing waves. The present invention serves as both a sound reproducer and a low frequency sound absorber due to its large surface area and the reflective nature of low frequency sound reproduction in a room. The inventive transducer behaves more like a tuned bass trap at multiple frequencies—absorbing reflections. The most effective placement will be along adjacent walls, as is shown in FIG. 13. The inventive transducers can be placed around the listening position rather than adjacent to it.

The inventive transducer also has a very large moving surface area compared to prior art woofers. The use of multiple inventive transducers on adjacent walls means that the sound energy from one transducer will be partially phase-cancelled by the adjacent transducer—as opposed to being reflected. A large radiating area diaphragm becomes a point source to a much lower frequency. The result is that room resonance modes are diminished and the frequency response is improved and made more uniform across the listening area. This phenomenon eliminates the need for low frequency absorbers (conventionally used to flatten low frequency response).

The reduced weight of the inventive transducer is largely the result of reduced cabinetry. A conventional woofer needs a large and rigid structure. In the inventive design the actuators "float" between two flexible surfaces. The flexible surfaces act as the "diaphragm." The main mass of the actuators (magnet, pole piece, chassis) are largely stationary. There is no need for a rigid enclosure. The diaphragm movement on either side of the actuators creates a monopole with a large surface area. The electrical current needed to produce a given amount of force on the diaphragm is much lower than that required for a conventional woofer.

Many other variations and combinations will occur to those skilled in the art. Examples include:

1. Elongated actuators can be used to reduce or even eliminate the need for stiffening braces.

2. The stiffening braces can be molded into the panel using conventional composite manufacturing techniques.

3. A recess or surrounding rib for locating the actuators can be molded into the panel using conventional composite manufacturing techniques.

4. Some or all of the assembly can be created using fasteners instead of adhesives.

5. Other conventional speakers can be combined with the inventive transducer—such as the additional of a small tweeter to the frame.

The preceding description contains significant detail regarding the novel aspects of the present invention. They should not be construed, however, as limiting the scope of the invention but rather as providing illustrations of the preferred embodiments of the invention. Thus, the scope of the invention should be fixed by the following claims, rather than by the examples given.

What is claimed is:

1. A sound transducer, comprising:

(a) a front panel made of thin and stiff material, said front panel having a front panel perimeter;

(b) a back panel made of thin and stiff material, said back panel having a back panel perimeter;

(c) a frame joining said front panel perimeter to said back panel perimeter;

(d) an actuator having a first side and second side, said actuator being configured to respond to a first electrical current by urging said first side away from said second side and a second electrical current by urging said first side toward said second side;

(e) said first side of said actuator being attached to said front panel; and (f) said second side of said actuator being attached to said back panel.

2. The sound transducer as recited in claim 1, further comprising a hanger.

3. The sound transducer as recited in claim 2, further comprising a standoff.

4. The sound transducer as recited in claim 3, further comprising:

(a) a front stiffening brace connected between said first side of said actuator and said front panel; and (b) a back stiffening brace connected between said second side of said actuator and said back panel.

5. The sound transducer as recited in claim 2, further comprising:

(a) a front stiffening brace connected between said first side of said actuator and said front panel; and (b) a back stiffening brace connected between said second side of said actuator and said back panel.

6. The sound transducer as recited in claim 1, further comprising a plurality of additional actuators, wherein each of said plurality of actuators is attached to said front panel and said back panel.

7. The sound transducer as recited in claim 6, wherein said actuators are arranged in an evenly-spaced array.

8. The sound transducer as recited in claim 7, further comprising:

(a) a first set of front stiffening braces connected between said actuators and said front panel; and (b) a second set of back stiffening braces connected between said actuators and said back panel.

9. The sound transducer as recited in claim 6, further comprising:

(a) a front stiffening brace connected between said first side of said actuator and said front panel; and (b) a second set of back stiffening braces connected between actuators and said back panel.

10. The sound transducer as recited in claim 1, further comprising:

(a) a front stiffening brace connected between said first side of said actuator and said front panel; and (b) a back stiffening brace connected between said second side of said actuator and said back panel.

11. A sound transducer, comprising:

(a) a flexible front panel having a front panel perimeter;

(b) a flexible back panel having a back panel perimeter;

(c) a frame joining said front panel to said back panel, but leaving an open interior area;

(d) an actuator having a first side and second side, said actuator being located in said open interior area, said actuator configured to respond to a first electrical current by urging said first side away from said second side and a second electrical current by urging said first side toward said second side;

(e) said first side of said actuator being attached to said front panel; and (f) said second side of said actuator being attached to said back panel.

12. The sound transducer as recited in claim 11, further comprising a hanger.

13. The sound transducer as recited in claim 12, further comprising a standoff.

14. The sound transducer as recited in claim 13, further comprising:

(a) a front stiffening brace connected between said first side of said actuator and said front panel; and (b) a back stiffening brace connected between said second side of said actuator and said back panel.

15. The sound transducer as recited in claim 12, further comprising:

(a) a front stiffening brace connected between said first side of said actuator and said front panel; and (b) a back stiffening brace connected between said second side of said actuator and said back panel.

16. The sound transducer as recited in claim 11, further comprising a plurality of additional actuators, wherein each of said plurality of actuators is attached to said front panel and said back panel within said open interior area.

17. The sound transducer as recited in claim 16, wherein said actuators are arranged in an evenly-spaced array.

18. The sound transducer as recited in claim 17, further comprising:

(a) a first set of front stiffening braces connected between said actuators and said front panel; and (b) a second set of back stiffening braces connected between said actuators and said back panel.

19. The sound transducer as recited in claim 16, further comprising:

(a) a first set of front stiffening braces connected between said actuators and said front panel; and (b) a second set of back stiffening braces connected between said actuators and said back panel.

20. The sound transducer as recited in claim 11, further comprising:

(a) a front stiffening brace connected between said first side of said actuator and said front panel; and (b) a back stiffening brace connected between said second side of said actuator and said back panel.

* * * * *